US007967500B2

(12) United States Patent
Arribau et al.

(10) Patent No.: US 7,967,500 B2
(45) Date of Patent: Jun. 28, 2011

(54) SPLIT VANE BLENDER

(75) Inventors: Jorge O. Arribau, Englewood, CO (US); Michael G. Dubic, Centennial, CO (US)

(73) Assignee: CE & M LLC, Englewood, CO (US)

( * ) Notice: Subject to any disclaimer, the term of this patent is extended or adjusted under 35 U.S.C. 154(b) by 968 days.

(21) Appl. No.: 11/879,119

(22) Filed: Jul. 16, 2007

(65) Prior Publication Data

US 2007/0258317 A1 Nov. 8, 2007

Related U.S. Application Data

(63) Continuation-in-part of application No. 10/836,555, filed on Apr. 29, 2004, now Pat. No. 7,334,937, which is a continuation-in-part of application No. 10/428,276, filed on May 2, 2003, now Pat. No. 6,974,246.

(51) Int. Cl.
*B01F 5/12* (2006.01)

(52) U.S. Cl. ..... 366/164.6; 366/317; 415/98; 415/102; 415/206; 416/203

(58) Field of Classification Search ..... 366/164.6, 366/317; 415/84, 87, 98, 102, 198.1, 206, 415/211.1; 416/203
See application file for complete search history.

(56) References Cited

U.S. PATENT DOCUMENTS 715,441 A * 12/1902 Vandergrift ..... 415/87
727,032 A * 5/1903 Tubbs ..... 261/32
865,128 A * 9/1907 Smith ..... 416/175
1,062,803 A 5/1913 Simond
2,226,470 A 12/1940 McGuffee
2,272,573 A 2/1942 Messmore
2,569,439 A * 10/1951 Blake ..... 366/155.2
3,256,181 A 6/1966 Zingg et al.
3,326,536 A 6/1967 Zingg et al.
3,339,897 A 9/1967 Davis et al.
3,371,614 A * 3/1968 Crisafulli ..... 415/98
3,953,150 A 4/1976 Onal
4,239,396 A 12/1980 Arribau et al.
4,453,829 A 6/1984 Althouse, III
4,460,276 A 7/1984 Arribau et al.
4,614,435 A 9/1986 McIntire
4,628,391 A 12/1986 Nyman et al.
4,834,542 A 5/1989 Sherwood
4,850,702 A 7/1989 Arribau et al.
4,893,941 A 1/1990 Wayte
5,460,444 A * 10/1995 Howorka ..... 366/3
5,904,419 A 5/1999 Arribau
6,428,711 B1 8/2002 Nakamura et al.
(Continued)

*Primary Examiner* — David L Sorkin
(74) *Attorney, Agent, or Firm* — The Reilly Intellectual Property Law Firm, P.C.; John E. Reilly; Ellen Reilly

(57) ABSTRACT

An impeller vane assembly for blending liquids with solid particulate matter in which a center drive shaft extends through a housing having a solid particle inlet and a liquid inlet together with an outlet, and upper and lower impeller vanes are aligned respectively with the particle inlet and liquid inlet to cause intermixing of the solids and liquids by counterflow of the liquid into the upper impeller region, the upper and lower vanes being separated by a common divider plate, the upper vanes being radially split and lower vanes having outer split tips, the vanes being operative to balance the point at which the solids and liquid are intermixed between the solid particle inlet and annular space surrounding the impeller. In one embodiment, inner concentric expeller blades are employed with the upper impeller vanes to accelerate the flow of solid particles.

25 Claims, 10 Drawing Sheets

U.S. PATENT DOCUMENTS 6,877,954 B2 * 4/2005 Lin et al. ..... 416/175
6,974,246 B2 12/2005 Arriabua et al.
7,334,937 B2 * 2/2008 Arribau et al. ..... 366/164.6
2004/0218464 A1 * 11/2004 Arribau et al. ..... 366/164.6
2004/0218465 A1 * 11/2004 Arribau et al. ..... 366/164.6

* cited by examiner

SPLIT VANE BLENDER

CROSS-REFERENCE TO RELATED APPLICATIONS

This application is a continuation-in-part of patent application Ser. No. 10/836,555, now U.S. Pat. No. 7,334,937, filed 29 Apr. 2004 for IMPELLER VANE ASSEMBLY FOR LIQUID/SOLID BLENDERS by Jorge O. Arribau and Michael G. Dubic which is a continuation-in-part of Ser. No. 10/428,276, filed 2 May 2003 for METHOD AND APPARATUS FOR BLENDING LIQUIDS AND SOLIDS INCLUDING NOVEL AND IMPROVED IMPELLER ASSEMBLY by Jorge O. Arribau and Michael G. Dubic (now U.S. Pat. No. 6,974,246), both incorporated by reference herein.

BACKGROUND AND FIELD

This invention relates to blenders as well as pumping apparatus; and more particularly relates to a novel and improved method and apparatus for blending liquids with solid particulate materials, and still further relates to a novel and improved impeller assembly which is conformable for use with blenders as well as centrifugal pumps.

Numerous types of blenders have been devised for intermixing and pumping large volumes of liquid/solid slurries. For example, downhole operations in oil and gas fields, such as, fracturing and cementing operations utilize a blender in which liquids and solids are introduced into a housing, a rotor within the housing, upper and lower impeller portions for intermixing the materials and throwing or advancing the materials outwardly into an annulus surrounding the rotor from which the resultant intermixture or slurry can be discharged into the well. A representative blender is that set forth and described in U.S. Pat. No. 5,904,419 to Jorge O. Arribau, one of the inventors of this invention which patent is incorporated by reference herein (hereinafter referred to as the '419 patent). Other representative patents are U.S. Pat. No. 4,239,396 to Arribau; U.S. Pat. No. 3,256,181 and U.S. Pat. No. 3,326,536 to Zingg; U.S. Pat. No. 4,850,702 to Arribau and U.S. Pat. No. 4,460,276 to Arribau.

In the '419 patent, liquids were introduced through mixing apertures intermediately between the rotor and annulus for mixing with the solid particles prior to introduction into the relatively high pressure annulus.

There is a continuing but unmet need for a blender of simplified construction which can regulate the balance or mixing point between the solids and slurry in a region radially outwardly of the eye and be capable of pumping the slurry under a substantially constant pressure over a wide range of mass flow rates. There is similarly a need for an impeller assembly in which impeller vanes are designed to regulate the slurry pressure as well as to prevent liquid or slurry leakage back into the eye or central expeller area. Still further, to decrease the depth of vanes required for the upper impeller region by encouraging more immediate outward flow of sand to achieve the same capacity or mass flow rate as deeper vanes.

SUMMARY

It is therefore an object to provide for a novel and improved method and apparatus for blending liquids and solid particles by counterflow of the liquid with respect to the direction of solid flow through an impeller region and establish a balance point between the liquid and solid particle intermixture in an impeller for a blender as well as the pressure/velocity ratio of liquid/solid flow by regulating the size, length and configuration of the impeller vanes; also, to prevent backflow of liquids or solid particles around impeller zones of a blender apparatus by maintaining substantially constant pressure of a liquid/solid slurry over a wide range of mass flow rates.

In apparatus for blending liquids with solid particles in which a housing has an upper solid particle inlet and lower liquid inlet, a center drive shaft in the housing and an outlet communicating with an annular space in outer spaced surrounding relation to the drive shaft; upper impeller vanes are mounted for rotation on the shaft whereby to direct solid particles from the inlet toward the annular space; lower impeller vanes are mounted for rotation on the drive shaft whereby to direct liquid from the liquid inlet through the annular space to intermix by counterflow of the liquid with the solid particles; and a divider plate is interposed between the upper and lower impeller vanes. In one form, the upper impeller includes inner and outer concentric vanes, the inner vanes being operative to force the solid particles into the outer impeller vane region at a rate sufficient to substantially reduce the height of the outer vanes necessary to intermix the desired ratio of solid particles to liquids and prevent any tendency of the solid particles to back up into the center inlet region. In another form, the radial tips of the upper impeller vanes are lengthened to discourage return flow of the liquids or slurries toward the center of the impeller region. In another embodiment, the upper impeller is characterized by having a series of circumferentially spaced, generally V-shaped vanes in which the trailing side of each vane will prevent return flow of the liquid or liquid/solid mixture toward the inner radial area and particularly the eye of the impeller. Further, a lower impeller has circumferentially spaced, curved vanes with outer radial split tip end portions, the leading tip end portion discouraging reverse flow of the water into the next pocket between the vanes.

In addition to the articles of manufacture described above, further aspects and embodiments will become apparent by reference to the drawings and by study of the following descriptions. Exemplary embodiments are illustrated in reference to Figures of the drawings. It is intended that the embodiments and Figures disclosed herein are to be considered illustrative rather than limiting.

DETAILED DESCRIPTION OF ONE EMBODIMENT

Figure 1:
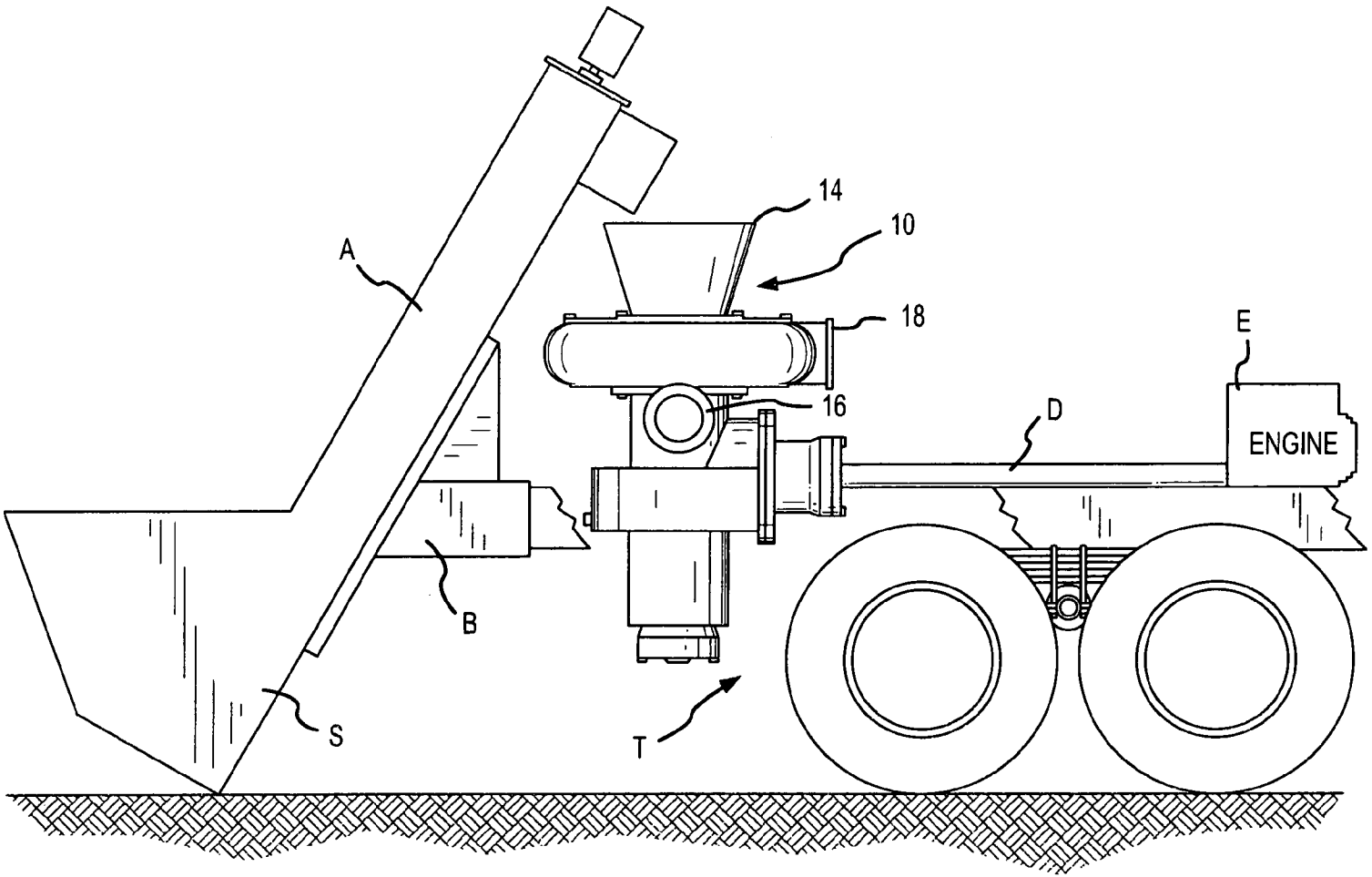
FIG. 1 is a somewhat fragmentary view of one form of blender apparatus mounted on a truck.
Figure 2:
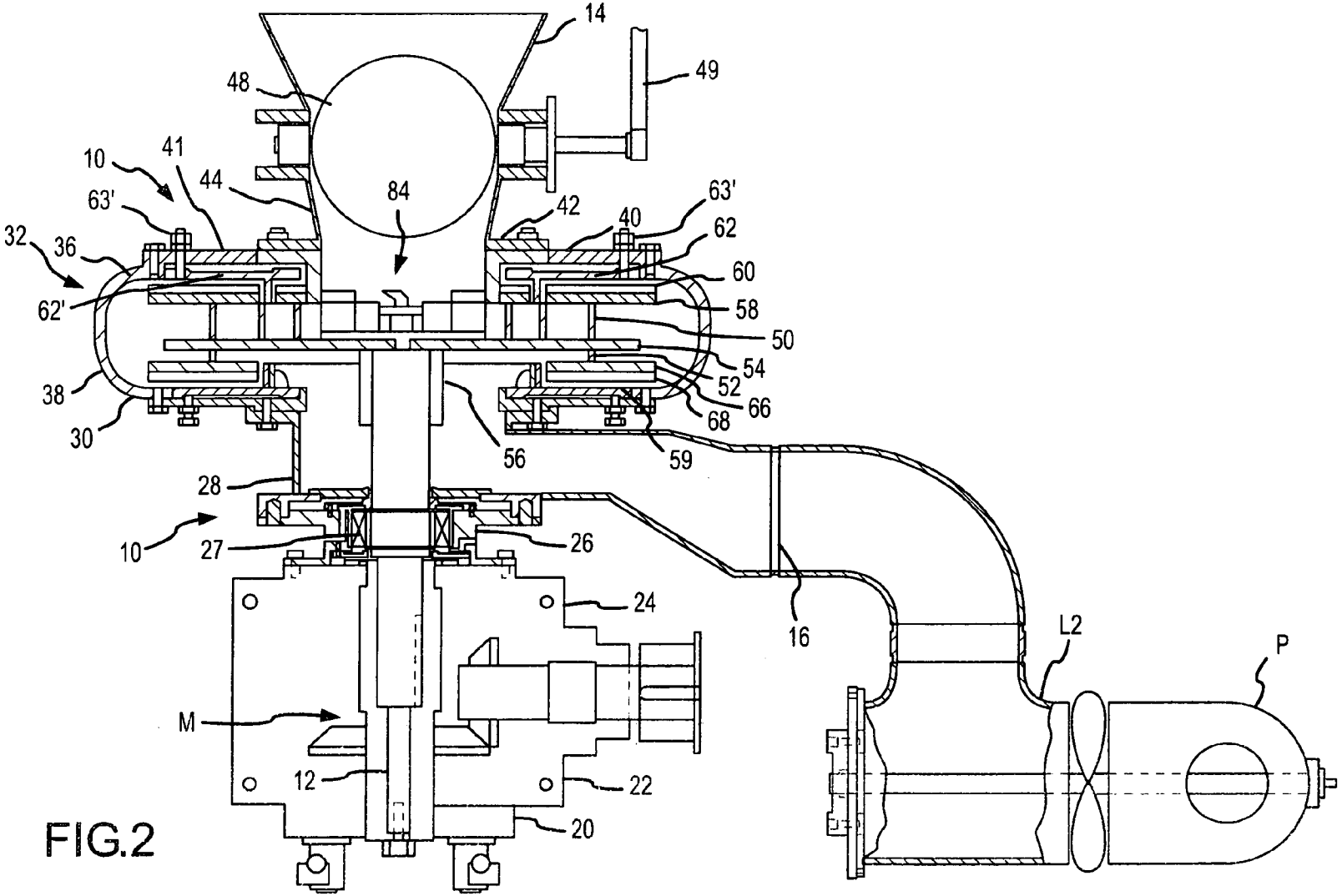
FIG. 2 is a longitudinal sectional view of a modified form of blender utilized in combination with a booster pump.

Referring in more detail to the drawings, one form of blender apparatus is illustrated in FIGS. 1 to 7, and FIG. 1 illustrates a typical mounting of a blender unit 10 on a truck T. The blender unit 10 is illustrated in more detail in FIG. 2 and includes a booster pump P communicating through line $L_2$ to the intake port 16 of the unit. Referring to FIGS. 1 and 2, in oil and gas operations, such as, fracturing or cementing wells, the unit 10 is mounted on a truck bed B including an engine E with a drive mechanism D to impart rotation via speed reducer mechanism M to a central drive shaft 12. The solid particulate matter, such as, sand is delivered from a storage area S by means of an auger system represented at A to the upper end of a hopper 14. There, the sand is permitted to advance by gravity into the apparatus 10. The sand is thoroughly mixed with a liquid which is introduced through the inlet line $L_2$ and the booster pump P into the inlet port 16; and the resultant slurry is discharged via outlet port 18 through a delivery line $L_1$ under sufficient pressure to be delivered to other trucks for delivery to a well head. The booster pump P regulates the pressure in the annulus of the impeller assembly and can be closely controlled to maintain a constant suction or pressure head from the outlet of the pump P to the inlet port 16 as well as to increase the pressure as desired. The booster pump P also can be run backwards to reduce the pressure or to maintain optimum pressure. For the purpose of illustration but not limitation, one suitable type of booster pump which can be utilized for this purpose is the Model AP/MPAF manufactured and sold by Goulds Pumps of Seneca, N.Y.

The speed reducer M, as shown in FIG. 2, is a right angle drive to enable the blender unit 10 to be oriented vertically in order to receive the sand and other dry chemicals under gravity flow through the hopper 14. The sand screw assembly or auger A, FIG. 1, has the capability of introducing sand from the storage area S to a point at least 38" above the expeller of the hopper 14 so that the mass flow rate of sand downwardly through the hopper is sufficient to produce the desired flow rate of sand in the slurry through the discharge port. While the apparatus is described and shown as being truck-mounted, it will be appreciated that it can be mounted on a fixed support and be oriented vertically or canted at an angle, such as, in the manner disclosed in hereinbefore referred to U.S. Pat. No. 5,904,419.

The unit 10 also includes a base mount 20 having a bearing to support the lower end of the drive shaft 12 in journaled relation to the mount, a square housing 22 extending upwardly from the base mount 20 into an enlarged housing area 24 for the speed reducer mechanism M, and an intermediate casing 26 includes a bearing 27 within which an intermediate portion of the drive shaft 12 is journaled. The upper end of the casing 26 terminates in a manifold 28 for the intake port 16 and is attached to a substantially flat underside 30 of an impeller housing 32 for an impeller assembly generally designated at 84 within the housing 32 as shown in FIG. 2. The underside 30 is of annular configuration and disposed in outer spaced concentric relation to the drive shaft 12, the impeller assembly 34 being mounted for rotation on the upper end of the drive shaft 12.

Figure 3:
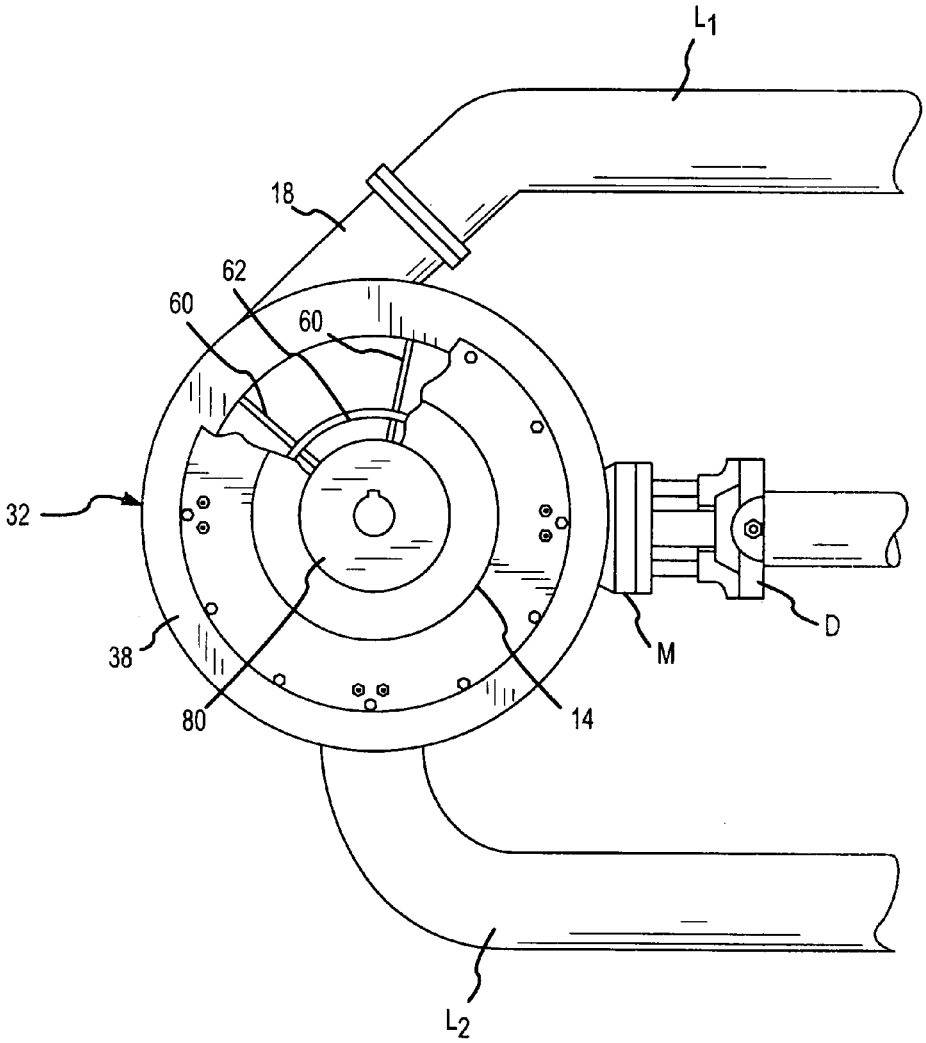
FIG. 3 is a top plan view with a portion of the top cover broken away of the form of blender shown in FIGS. 1 and 2.

As shown in FIGS. 2 and 3, the impeller housing 32 has a substantially flat top side surface 36 of annular configuration parallel to the underside 30 and joined to the underside 30 by an outer continuous wall 38 of generally convex or toroidal cross-sectional configuration. The hopper 14 converges downwardly through a central opening in an upper flat, annular connecting plate 42 which is attached by suitable fasteners to the plate 40 and has an inner thickened ring-like portion 40. A flat support plate 41 forms an upper extension of the top side 36 and is affixed to an outer radial edge of the ring-like portion 40. A butterfly valve 48 with suitable hand control arm 49 is mounted in the hopper to seal off the mixer when desired and can assist in regulating the flow rate of sand into the impeller housing 32. The discharge port 18 extends tangentially away from the outer wall 38 of the housing 32, and the inlet port 16 extends radially into the housing 26 immediately below the expeller housing 32.

A feature of the impeller assembly 84 resides in the construction and arrangement of upper impeller vanes 50 and lower impeller vanes 52 interconnected by a common divider plate 54. The plate 54 is centered for rotation on the upper end of the drive shaft 12 by means of a cup-shaped retainer 56. The upper impeller vanes 50 are bounded by a top plate 58 having radially extending, circumferentially spaced expeller vanes 60 on its upper surface. An annular wear plate 62 is adjustably mounted between the support plate 41 and the vanes 60 by threaded fasteners 63 having lock nuts 63' at one end. The wear plate 62 has a circular rib 62' which projects downwardly through aligned circular slots 64 in the vanes 60, as best seen from FIG. 4, and can be adjusted up or down by the lock nuts 63' to regulate the spacing of the wear plate 62 above the cover plate 58. In this way, the rib or diverter 62' cooperates with the expeller vanes 60 in minimizing any return flow of slurry or liquids toward the central region of the impeller.

Figure 5:
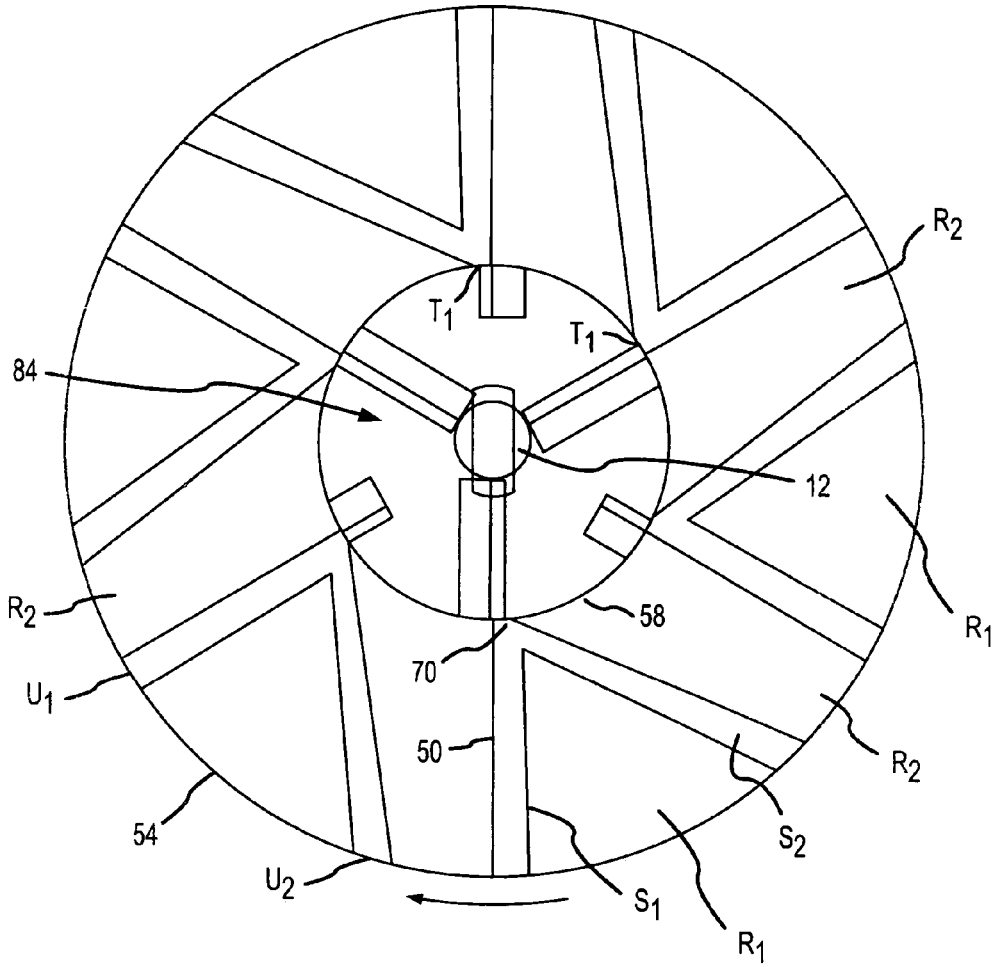
FIG. 5 is a top plan view in detail of the upper impeller vanes and inner concentric expeller vanes of the form of blender shown in FIGS. 1 and 2.

The upper vanes 50 are shown in detail in FIG. 5 and comprise a plurality of split, circumferentially spaced vane portions or blades extending upwardly from an upper surface of the divider plate 54. Each of the vanes 50 is of generally V-shaped configuration and split into a radially extending side $S_1$, and each of the split vanes or sides $S_1$ and $S_2$ are formed with a pie-shaped recess or space $R_1$ between sides $S_i$ and $S_2$. The sides $S_1$ and $S_2$ are straight, each side being of generally rectangular cross-sectional configuration and interconnected at an inner radial edge T of the divider plate 54. In turn, the outer radial edges $U_1$ and $U_2$ of the sides S1 and S2 terminate at the outer radial edge of the divider plate. The angle of divergency and length of each side $S_2$ is such that a second spacing space or recess $R_2$ is formed between each trailing side $S_2$ and the next successive radial side $S_1$ of each vane.

In working with granular materials, such as, sand, the vanes and particularly the sides $S_1$ increase in width or thickness in outward radial directions on account of the greater wear toward the outsides of the vanes 50. In turn, the trailing sides $S_2$ prevent return flow of the liquid into the central area of the impeller and maintains a more constant pressure as sand flows outwardly from the eye of the impeller.

Figure 7:
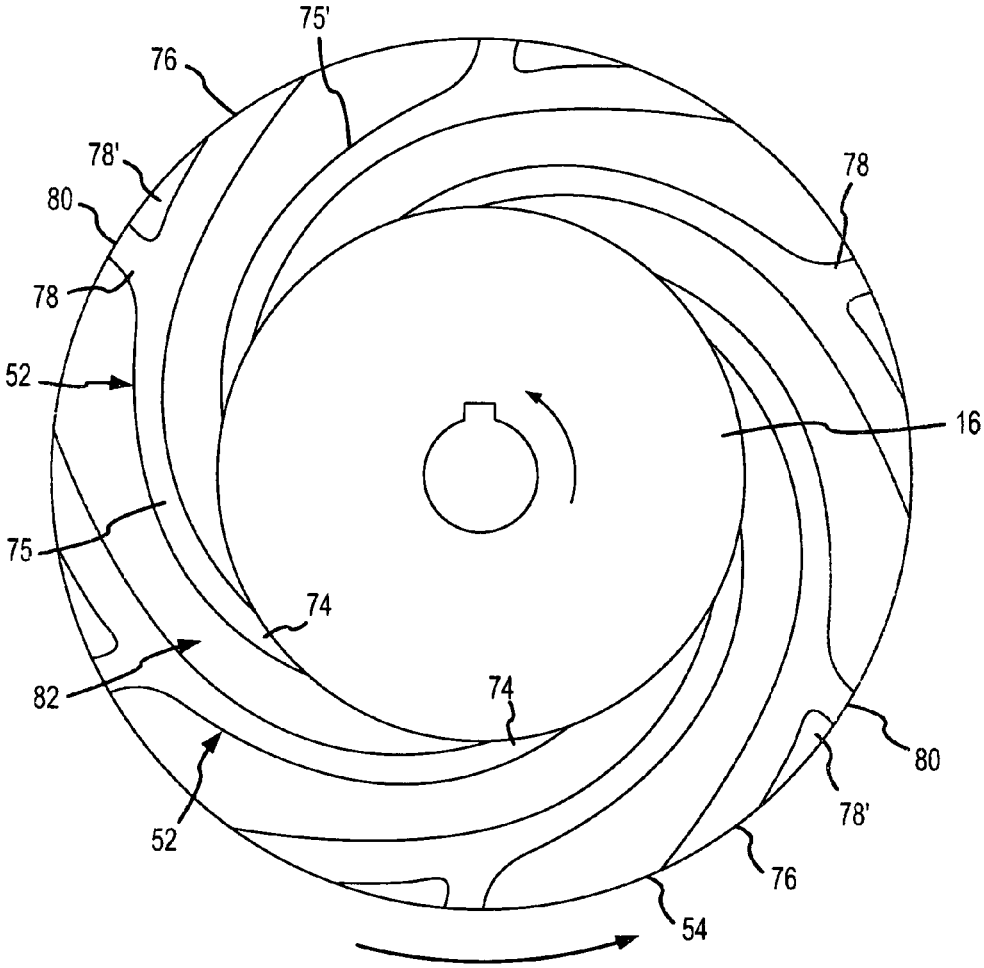
FIG. 7 is a bottom plan view of the lower impeller vanes of the form of blender shown in FIGS. 1 and 2.
Figure 8:
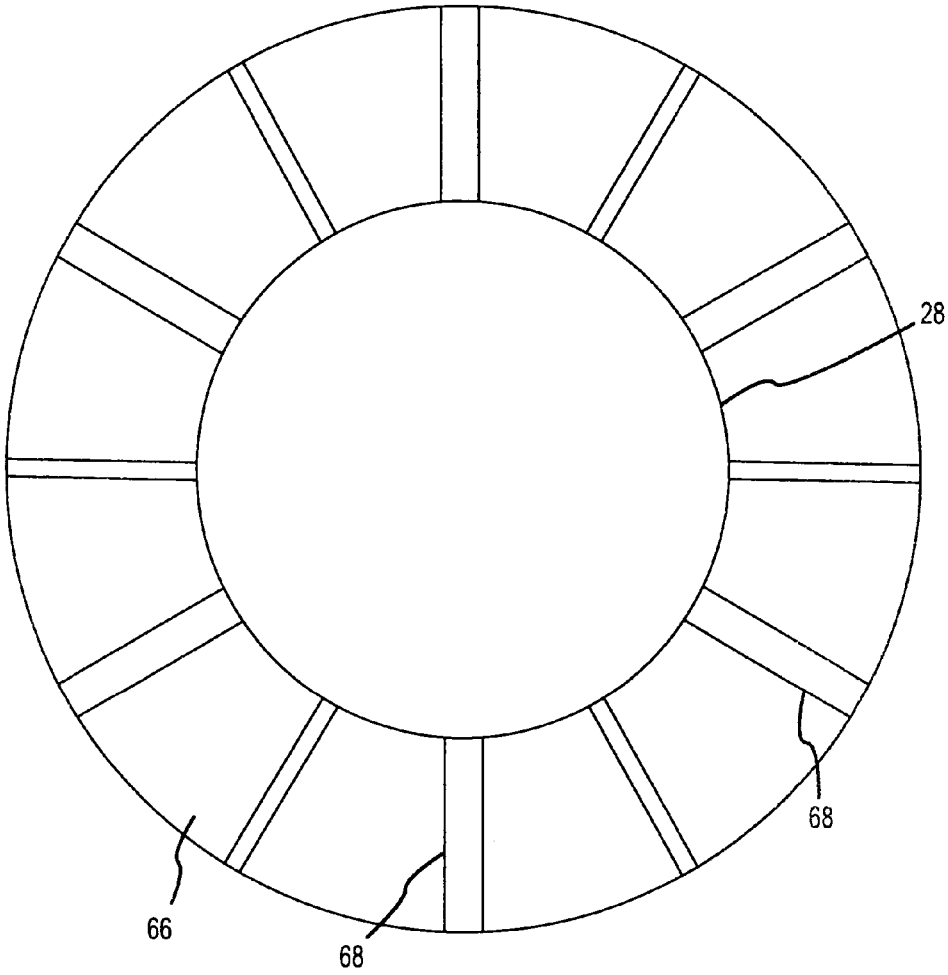
FIG. 8 is a bottom plan view of the bottom cover plate in the form of blender shown in FIGS. 1 and 2.

The lower vanes 52 shown in FIG. 7 are similarly bounded by a bottom cover plate 66, shown in FIG. 8, having downwardly extending, spaced expeller vanes 68 to discourage return flow of slurry or liquids around the underside of the housing. The lower vanes 52 extend downwardly from the divider plate 54 in circumferentially spaced relation, and a wear plate 59 is mounted in the underside 30 of the housing 32 beneath the vanes 68. Each vane 52 has an inner somewhat tangential tip or edge 74, an arcuate portion 75 curving outwardly from the inner radial edge 74 and a convex surface 75' along the entire length of the vane 52, the convex surface 75' facing in the direction of rotation of the impeller assembly over the entire length of each vane and terminating in an outer radial tip or edge 76. In addition, a radially directed split end portion 78 branches radially outwardly from the arcuate portion 75 and terminates in an outer radial tip or edge 80. The space or recess 82 between the vanes 52 diverges in an outward radial direction from the inner tip 74 to the outer tip 80, and the split end portions 78 have a shallow recess 78' therebetween.

The lower vanes 52 curve outwardly from the central opening or intake 16 of the impeller assembly and, under clockwise rotation of the impeller assembly, the liquid flowing outwardly between the vanes 52 will undergo an outward radial change in direction of flow as influenced by the split end portions 78 and impart more of a swirling action to the liquid into the annulus. As the liquid flows upwardly around the outside of the divider plate 54 into the annulus of the impeller casing 32 surrounding the impeller vanes 52 and 50 into the upper impeller region, it starts to mix with the sand which is discharged by the expeller vane assembly, and the upper split vanes $S_1$ and $S_2$ will discourage counterflow of the liquid/sand slurry and which will eventually be driven outwardly through the discharge port 18. The balanced pressure or balance point between the sand and water in the upper impeller region can be regulated by the relative length of the vanes 50 and 52 as well as the liquid pressure and mass flow rate of sand delivered through the upper hopper as well as the relative height of the upper impeller vanes 50 to the lower vanes 52.

Figure 4:
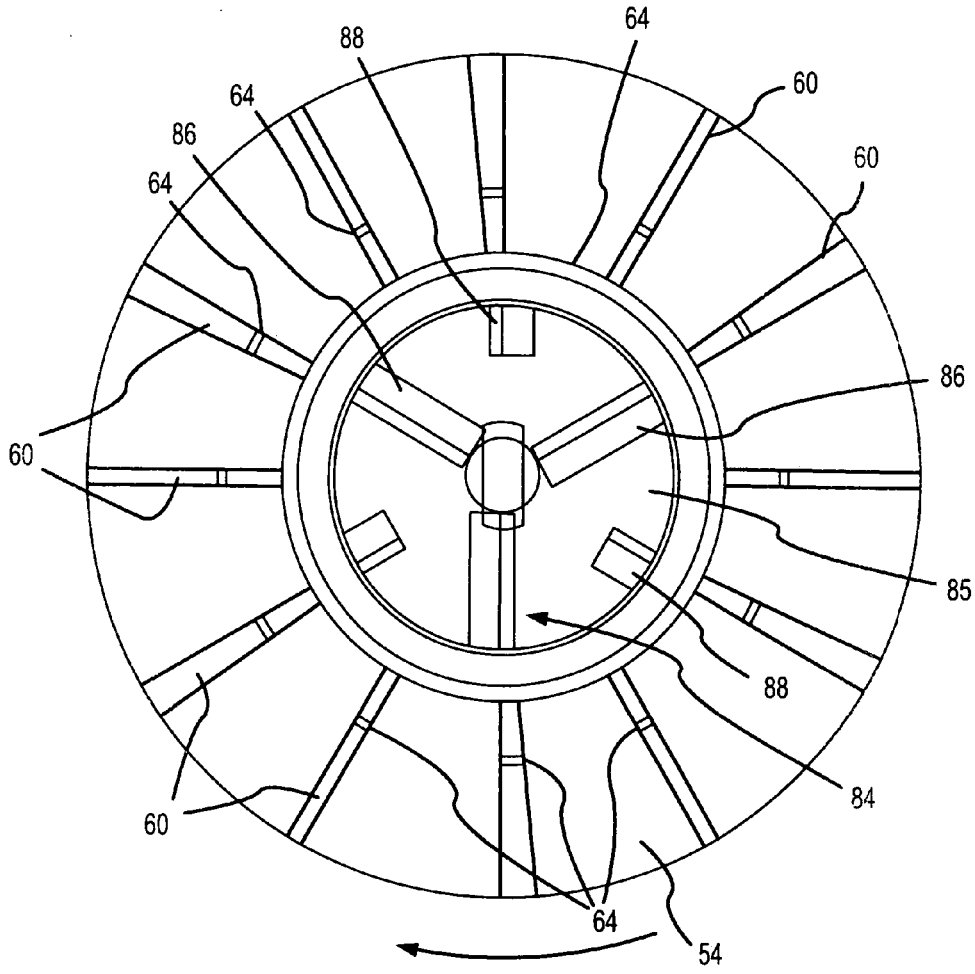
FIG. 4 is a top plan view in detail of the top cover plate and inner concentric expeller vanes of the blender shown in FIGS. 1 and 2.
Figure 6:
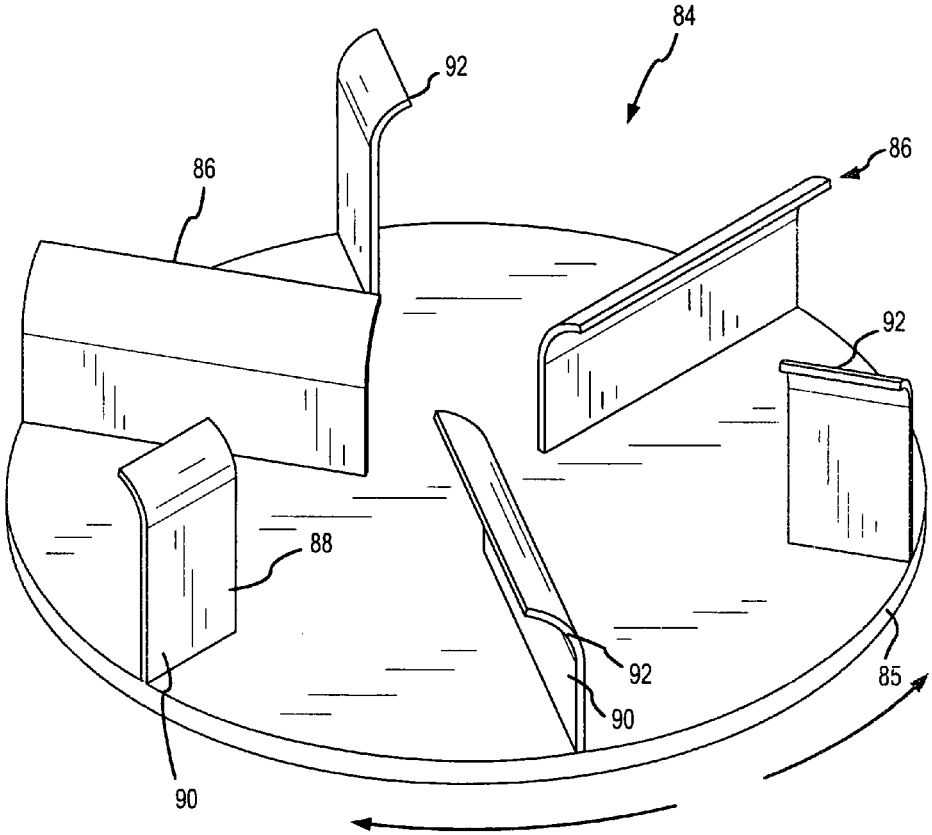
FIG. 6 is an elevational view in detail of the inner concentric expeller vanes shown in FIGS. 2 and 4.

The lower portion 44 of the hopper terminates above an expeller vane assembly 84 shown in FIGS. 4-6 comprised of a base or mounting plate 85 which is mounted on an inner concentric portion of the divider plate 54 for rotation on the drive shaft 12, and a series of expeller vanes are made up of a combination of alternating longer, straight radial vanes 86 extending from the center axis of the expeller vane assembly and substantially shorter but taller vanes 88 extending radially inwardly from the outer edge of the base plate 85. The vanes 86 and 88 have corresponding cross-sections, each having a straight, generally rectangular support block 90 and an upper or outer angled blade portion 92. The vanes 86 extend radially outwardly from the upper end of the drive shaft to the outer peripheral edge of the base or mounting plate 85, and the vanes 88 extend radially inwardly from the outer edge of the plate 85 for a distance such that the shorter vanes 88 will cover substantially the same area as the longer but lower profile vanes 86 and in this way equalize the amount of sand or other granular material engaged by each set of vanes 86 and 88, respectively, so as to avoid imbalance. Thus, the shorter vanes 88 will first contact the sand along the outer region of the expeller and throw the sand sideways and outwardly without contacting the longer vanes 86; and the longer vanes will contact the sand along the inner region of the expeller and force it in a circumferential and radially outward direction with little or no contact with the vanes 88.

DETAILED DESCRIPTION OF ALTERNATE EMBODIMENTS

Figure 9:
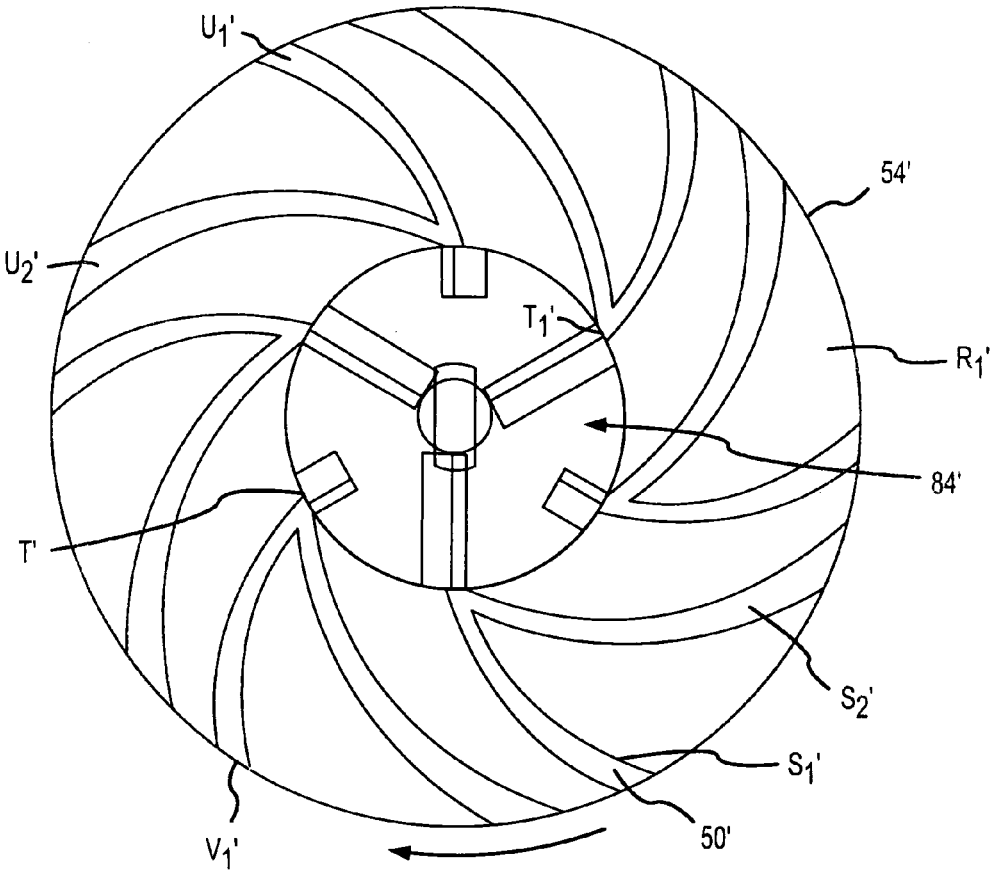
FIG. 9 is a top plan view of modified upper impeller vanes.
Figure 10:
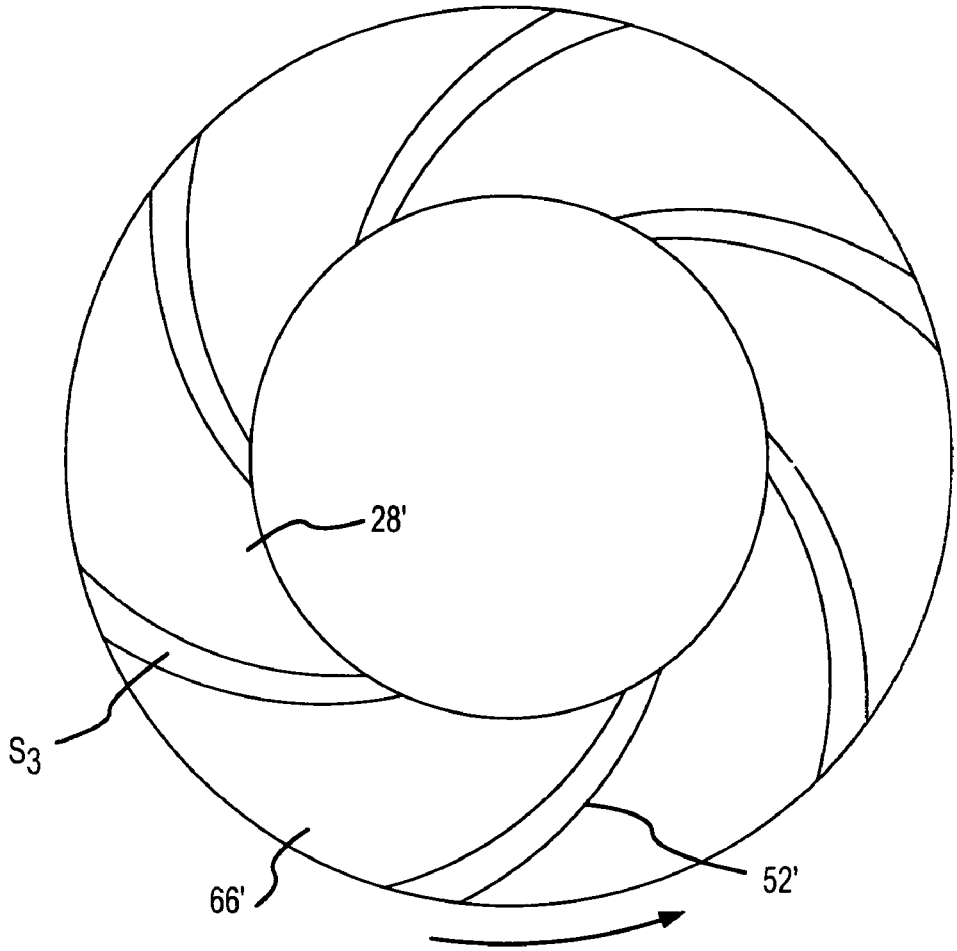
FIG. 10 is a bottom plan view of a modified form of lower impeller vanes.

FIGS. 9 and 10 illustrate an alternate form of impeller assembly 34' wherein like or similar parts are correspondingly enumerated with prime numerals. Thus, the plate 54' is centered for rotation on the upper end of the drive shaft 12' in the same manner as described with reference to FIGS. 5 and 7. It will be apparent that an expeller vane assembly 84 of the type shown in FIGS. 4-6 may be utilized in cooperation with the upper impeller vanes 50'. The vanes 50' are made up of split, circumferentially spaced vane portions or blades which extend upwardly from the divider plate 54' and are progressively increased in thickness from their inner radial edges T' to their outer radial edges $U_1'$ and $U_2'$. In addition, as opposed to being straight, the vanes 50' are curved or bowed so as to be of generally arcuate configuration along their length from the inner edges T' to outer edges $U_1'$ and $U_2'$. Accordingly, as illustrated, the vanes 50' would present generally convex surface portions in the direction of rotation of the impeller 54'. The number of vanes may be varied according to the capacity or amount of material being pumped through the assembly.

FIG. 10 illustrates a modified form of lower vanes 52' which are curved or bowed to be of generally arcuate configuration in a radial direction away from the central drive shaft. In addition, the individual vane members increase in thickness or width from their inner radial edges to their outer radial edges and correspond in number and spacing to one side $S_1$ of the split vanes 52' and of course the number of vanes may be varied. For example, FIGS. 9 and 10 illustrate an upper vane 50' and a lower vane 52' but could very well be a greater or lesser number depending on the speed and desired capacity of the blender.

The following working example is given for the purpose of illustration in the utilization of the blender method and apparatus of the preferred form of invention in mixing sand and water and delivering continuously to a high horse power and high pressure fracturing pump truck: The inlet end of the impeller at the lower reduced end 44 of the hopper 14 is 10" less the diameter of the center fastener 82 for the expeller blades 84, and the sand is delivered at a constant rate through the auger A to a point no less than 28" above the expeller in order to reach a vertical speed of 73.55" per second needed to meet the design criteria of 20,000 lbs. of sand per minute through the opening. Once it has reached the expeller the sand is trapped by the angle blade portions 92 of the expeller blade and is pushed down at the same time that it is accelerated outwardly. This portion of the expeller blade increases the time required to accelerate the sand reducing the impact and the possible crushing of the sand. Again, in order to reach the design criteria of 20,000 lbs. of sand per minute through the outlet 18, the expeller blades 86 and 92 are 2.5" and 2" high, respectively, and impeller vanes 50 are 3.5" in depth and vanes 52 are 2" in depth are rotated at 1050 rpm. The water is pumped into the inlet 16 with the aid of the booster pump P and is accelerated upwardly through the lower impeller zone until it reaches the vanes 52 whose inner tips are at a radius of 7". The water is further accelerated by the vanes 52 until it reaches the outer tips of the vanes, at a radius of 24", whereupon the liquid is driven into the annulus and energized to a pressure of approximately 70 psi. The liquid will then occupy the entire annulus and begin to invade the upper set of longer impeller vanes 50 which are rotating at the same rpm as the lower and shorter vanes 52 and therefore opposing the entrance of the liquid into the upper section of the impeller. Once the liquid has entered the upper vanes 50 it will have dissipated its energy somewhat, and any tendency of the liquid to reach the eye of the impeller will be overcome by the length of the upper vanes 50 which will be on the order of 7" compared to the lower vanes which are on the order of 5". Accordingly, the eye of the upper impeller will be free of liquid so as not to interfere with the introduction of the sand from the auger A.

The expeller blades 92 and 86 will impart a radial velocity on the order of 549.80" per second as a result of which it is not necessary to have a higher depth of sand expeller vane 50 than 3.5". Furthermore, once the sand has entered blade 50 it will be accelerated to an exit speed of 1,319.5" per second. Thus, the spacing between blades $S_1$ and $S_2$ may be more on the order of 0.6" to 1.0" and therefore considerably more compact for the mass rate of flow of sand being handled. In addition, the expeller blades 50 reduce the area of the vanes which must be exposed to the pressurized liquid and therefore reduces the torque required to maintain the requisite rpm and correspondingly reduces the horsepower required on the engine. It will be evident that the size of the inlet may be reduced depending upon the amount or capacity of sand and water being discharged and therefore minimize the net positive suction head required.

The vane configuration devised for the preferred and modified forms of invention with the aid of the booster pump enable close control over the pressure of the solid and liquid materials in order to achieve optimum performance. For example, when the vanes are curved in the same direction as the direction of rotation, the pressure increases as the rate of flow of the materials increases and, in curving away from the direction of rotation, the pressure will decrease. However, any tendency to decrease can be overcome by adding the radial tip end portions $U_1$ and $U_2$ to the outer radial ends of the vanes. The use of the booster pump P greatly aids in controlling the flow and pressure characteristics of the water for a given rpm or speed of rotation of the vanes. Furthermore, the booster pump maintains a positive suction head and keeps the system primed should the operation of the mixture be temporarily stopped. The relative height and length of the expeller vanes 86 and 88 as well as the relative lengths of the upper and lower impeller vanes 50 and 52 as well as the RPMs can be varied to achieve different flow and pressure characteristics for a given speed of rotation of the vanes. It will be further evident that the vane configuration of the impeller vanes 50 and 52 is conformable for use in numerous applications other than blender apparatus and for example are adaptable for use in centrifugal pumps or in virtually any application where it is desirable to control the pressure of liquid or solid particles by regulating the curvature of the impeller vanes.

It is therefore to be understood that while different embodiments have been herein set forth and described, various modifications and changes may be made therein without departing from the spirit and scope of the present invention as defined by the appended claims.

We claim:

1. In apparatus for blending a liquid with solid particle's comprising a housing which has an upper solid particle inlet and a lower liquid inlet, a center drive shaft extending between said inlets, and an outlet in communication with an annular space in outer spaced surrounding relation to said drive shaft, the improvement comprising:

a divider plate mounted for rotation on said drive shaft;

an upper impeller member including a plurality of split, circumferentially spaced vanes extending upwardly from an upper surface of said divider plate, said vanes being of generally V-shaped configuration and split into a first radially extending side and a second side diverging radially outwardly at an acute angle away from said first radially extending side wherein at least one of said sides extends from an inner radial edge of said divider plate; and a lower impeller member including a series of circumferentially spaced lower vanes extending downwardly from an underside of said divider plate.

2. In apparatus according to claim 1 wherein said sides of said split vanes are straight over their greater length and interconnected at an inner radial edge of said divider plate.

3. In apparatus according to claim 2 wherein at least one of said sides of said split vanes terminate at an outer radial edge of said divider plate, and said radial sides are curved at their outer radial ends.

4. In apparatus according to claim 1 including a cover plate mounted on said split vanes and a bottom plate mounted on said lower vanes.

5. In apparatus according to claim 4 wherein said cover plate and said bottom plate are of annular configuration and have outer diameters substantially corresponding to an outer diameter of said divider plate.

6. In apparatus according to claim 5 wherein said cover plate includes radial vanes on a surface opposite to said upper impeller member.

7. In apparatus according to claim 1 wherein said housing includes a diverter member extending from a top surface of said housing into circumferential slots in said split vanes.

8. In apparatus according to claim 1 wherein said lower vanes are curved and have an inner radial arcuate portion with a convex surface facing in the direction of rotation over the greater length of each said lower vane and terminating in outer split radial tip end portions.

9. In apparatus according to claim 8 wherein one of said tip end portions is substantially perpendicular to the other of said tip end portions.

10. In apparatus according to claim 9 wherein said tip end portions terminate at the outer peripheral edge of said divider plate.

11. In apparatus for blending a liquid with solid particles, said apparatus comprising a housing which has an upper solid particle inlet and a lower liquid inlet, a central drive shaft extending between said inlets, and an outlet in communication with an annular space in outer spaced surrounding relation to said drive shaft, the improvement comprising:

a divider plate mounted for rotation on said drive shaft having a plurality of inner concentric expeller vanes and an upper impeller member in outer concentric relation to said inner concentric expeller vanes;

said upper impeller member including a plurality of circumferentially spaced, split vanes extending upwardly from an upper surface of said divider plate, each of said split vanes being of generally V-shaped configuration having a first radially extending side and a second side diverging at an angle away from said radial side, each of said split vanes provided with a recess between said sides;

a lower impeller member including a series of circumferentially spaced, curved vanes extending downwardly from an underside of said divider plate; and means for pumping liquid into said lower liquid inlet for intermixture with materials introduced through said upper solid particle inlet including a booster pump for maintaining a minimum pressure head between said inlet and outlet.

12. In apparatus according to claim 11 wherein said sides are curved in a radial direction and are interconnected at an inner radial edge of said divider plate.

13. In apparatus according to claim 12 wherein said sides of said split vanes terminate at an outer radial edge of said divider plate.

14. In apparatus according to claim 11 including a cover plate mounted on said split vanes and a bottom plate mounted on said curved vanes.

15. In apparatus according to claim 14 wherein said cover plate and said bottom plate are of annular configuration and have outer diameters corresponding to an outer diameter of said divider plate.

16. In apparatus according to claim 15 wherein said cover plate includes expeller vanes on a surface opposite to said upper impeller.

17. In apparatus according to claim 11 wherein said housing includes a diverter member extending from a top surface of said housing into circumferential slots in said expeller vanes.

18. In apparatus according to claim 11 wherein said curved vanes have an inner radial arcuate portion with a convex surface facing in the direction of rotation over the greater length of said vane and terminating in outer radial tip end portions.

19. In apparatus according to claim 18 wherein one of said tip end portions is substantially perpendicular to the other of said tip end portions.

20. In apparatus according to claim 19 wherein said tip end portions terminate at the outer peripheral edge of said divider plate.

21. In apparatus according to claim 11 wherein said inner concentric expeller vanes include alternating, longer vanes extending radially from a central axis of said drive shaft and substantially shorter vanes extending radially inwardly from an inner edge of said upper impeller member.

22. In apparatus according to claim 21 wherein each of said alternating vanes includes an upper blade portion angled in the direction of rotation of said drive shaft.

23. In apparatus according to claim 22 wherein said shorter vanes are dimensioned to extend upwardly a greater distance than said longer vanes to equalize the amount of sand engaged by said longer and shorter vanes.

24. In apparatus for blending a liquid with solid particles, said apparatus comprising a housing which has an upper solid particle inlet and a lower liquid inlet and a central drive shaft extending between said inlets the improvement comprising an outer concentric impeller and an inner concentric/expeller assembly including a mounting plate mounted on said central drive shaft having a plurality of alternating, longer vanes on said mounting plate extending radially from said drive shaft and substantially shorter vanes extending radially inwardly from an outer edge of said mounting plate, and said shorter vanes extending upwardly above said longer vanes.

25. In apparatus according to claim 24 wherein said alternating longer and shorter vanes are disposed in substantially equally spaced circumferential relationship to one another, and each of said alternating longer and shorter vanes includes an upper blade portion angled in the direction of rotation of said drive shaft.

* * * * *